United States Patent [19]

Meijer et al.

[11] Patent Number: 4,897,997

[45] Date of Patent: Feb. 6, 1990

[54] SHELL AND TUBE HEAT PIPE CONDENSER

[75] Inventors: Roelf J. Meijer; Robert P. Verhey, both of Ann Arbor, Mich.

[73] Assignee: Stirling Thermal Motors, Inc., Ann Arbor, Mich.

[21] Appl. No.: 233,732

[22] Filed: Aug. 19, 1988

[51] Int. Cl.[4] ..... F02G 1/04; F28D 15/02

[52] U.S. Cl. ..... 60/517; 60/525; 165/104.21; 165/913; 122/366

[58] Field of Search ..... 60/524, 525, 517; 165/104.26, 104.21, 913; 122/366

[56] References Cited

U.S. PATENT DOCUMENTS

| | | | |
|---|---|---|---|
| 2,529,915 | 11/1950 | Chausson | 165/104.21 |
| 3,731,660 | 5/1973 | Leffert | 165/104.26 |
| 4,237,866 | 12/1980 | Rush | 126/433 |
| 4,753,072 | 6/1988 | Johansson et al. | 60/524 |

FOREIGN PATENT DOCUMENTS

| | | | |
|---|---|---|---|
| 259861 | 12/1985 | Japan | 126/433 |
| 738053 | 5/1980 | U.S.S.R. | 165/104.21 |

*Primary Examiner*—Albert W. Davis, Jr.
*Attorney, Agent, or Firm*—Harness, Dickey & Pierce

[57] ABSTRACT

An improved conduit assembly for coupling a heat pipe evaporator with a Stirling engine heat exchanger. The conduit assembly features a cylindrical main tube section connected to a flared shell joining the heat exchanger of the Stirling engine. The flared shell provides an increasing cross-sectional area which reduces the velocity of vaporized heat pipe working fluid flowing from the heat pipe evaporator to the heat exchanger. Such reduced velocity has been found to minimize entrainment of liquid within the transmitted vapor. The conduit assembly further includes an internal small diameter liquid return duct which provides additional isolation of the liquid and vapor phases of the heat pipe working fluid as a means of further reducing entrainment. Surface tension breakers are provided which communicate the heat exchanger to the inlet end of the liquid return duct to wick away liquid working fluid from the heat exchanger. Contaminant gases within the heat pipe are removed through the use of an externally heated getter and an internal getter within the vapor flow path.

22 Claims, 2 Drawing Sheets

SHELL AND TUBE HEAT PIPE CONDENSER

BACKGROUND AND SUMMARY OF THE INVENTION

This invention relates to a Stirling engine of the type receiving heat inputs from a remote source, and particularly to a heat pipe transfer tube connected to such an engine.

In one form of the Stirling cycle engine, a number of reciprocating pistons within cylinders are arranged in generally parallel relationship in a square cluster. The top of each cylinder is attached to a gas duct which connects to a cylindrical column having a heat exchanger, regenerator, and cooler stacked end-to-end. One means of providing heat input energy to such a Stirling engine is to employ a heat pipe which has a remotely situated evaporator which absorbs heat from some source such as solar energy, combustion flue gasses, etc., which cause the working fluid to vaporize. The vaporized working fluid is transported to the engine heat exchanger where it condenses, thus giving up its latent heat of evaporation, and then returns to the heat pipe evaporator.

In such devices according to the prior art designs, a number of shortcomings exist in the design of the heat pipe conduits which transfer the working fluid from the evaporator to the engine heat exchanger (i.e., condenser). Since the working fluid vapor and liquid phases are typically transferred within a single conduit and travel in opposite directions, the liquid working fluid can become entrained within the vapor, particularly when the engine is operating at a high power setting. Such entrainment reduces the heat transfer rate to the engine and further can prevent adequate liquid working fluid return to the heat pipe evaporator which can lead to localized areas of the evaporator "drying out" and becoming excessively heated, potentially leading to mechanical failure. Furthermore, since Stirling engine heat exchangers are very compact, condensed heat pipe working fluid tends to collect in the heat exchanger due to capillary action which represents a waste of a certain volume of the working fluid, and also decreases the useful surface area in the heat exchanger. In view of the foregoing, there is a need to provide an improved heat pipe conduit and a means for reducing the retained volume of liquid working fluid within the Stirling engine heat exchanger.

During initial startup of a Stirling cycle engine, contaminant gases tend to be present in the heat pipe which supplies heat inputs to the engine. Such gases are present due to outgasing from the engine and heat pipe components and from other sources. Since the flow direction of the vaporized heat pipe working fluid is toward the condenser, the contaminant gases tend to collect in the upper portions of the heat pipe assembly in the area of the condenser. Such gases can form a "plug" which prevents the heat pipe working fluid from contacting the engine heat exchanger thus interfering with heat inputs to the engine. The use of getters using various substances fro absorbing impurity gases is known. The elements lanthanum and calcium are capable of absorbing many impurity gases if they are brought to an elevated temperature, e.g., 600 to 800 degree C. Such getters need to communicate with the impurity gases collecting in the upper portions of the engine heat exchanger. During initial operation, however, the heated heat pipe working fluid does not flow into these upper portions due to the previously mentioned impurity gas plug. Accordingly, there is a need to provide a getter assembly which absorbs impurity gases during initial Stirling engine startup.

The above mentioned desirable features are achieved in accordance with this invention through an ipmroved design heat pipe working fluid conduit assembly. The assembly features a shell and tube construction in which a flared shell joins the heat exchanger and provides a means of reducing the velocity of vaporized heat pipe working fluid as it enters the heat exchanger. This reduction in velocity tends to minimize problems of liquid entrainment within the vapor. As a further step to reduce entrainment, a separate liquid heat pipe working fluid return duct is provided within the conduit outer tube which provides isolation of the phases. A surface tension breaker is used which communicates the engine heat exchanger with the liquid return pipe as a means of reducing the volume of liquid working fluid retained by the heat exchanger. In another feature of this invention, a getter unit is provided adjacent to the condenser of the heat pipe which has an auxiliary heater for heating the active compounds of the getter, enabling it to absorb the impurity gases before heat pipe working fluid is capable of heating the getter assembly.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
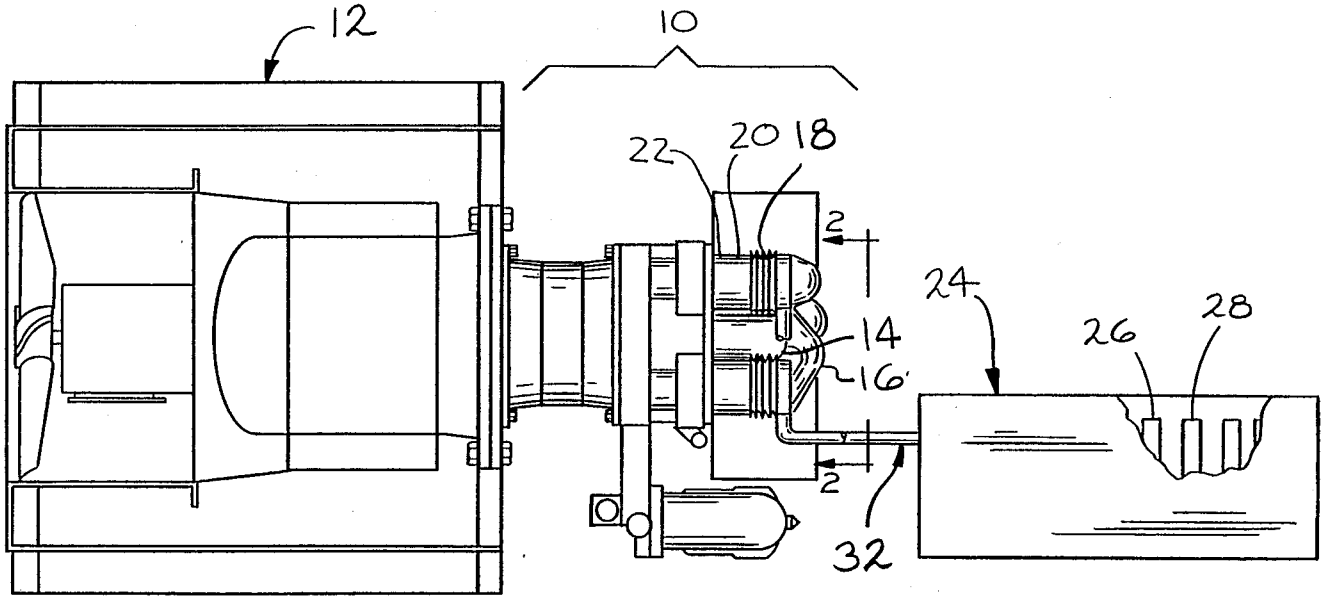
FIG. 1 is a pictorial view of a Stirling engine shown driving an electrical generator and receiving input energy from a heat pipe having an evaporator heated by flue gasses.

With reference to FIG. 1, a Stirling cycle engine generally designated by reference number 10 is shown for driving induction generator assembly 12. Stirling engine 10 is generally of the type described by U.S. Pat. No. 4,481,771, issued to the assignee of this invention which is hereby incorporated by reference. Stirling engine 10 includes four parallel working cylinders 14 arranged in a square cluster, each of which communicate via arcuate hot connecting duct 16 with a cylindrical column comprising heat exchanger 18, regenerator 20, and cooler 22. Heat inputs to Stirling engine 10 are provided by a remotely mounted heat pipe evaporator assembly 24 which is heated by flue gasses from a hydrocarbon fuel burner (not shown), or any other source of heat. Evaporator assembly 24 includes evaporator 26 with internal hollow fins 28 such as described by assignee's U.S. Pat. No. 4,523,636, which is also hereby incorporated by reference.

During operation, heat inputs to evaporator 26 cause the heat pipe working fluid, which may be, for example, sodium or other substances, to be transported through conduit assembly 32 to heat exchanger 18 which functions as the heat pipe condenser, where the heat is removed from the vaporized working fluid causing it to condense. The condensed working fluid is thereafter returned to heat evaporator assembly 26 where the cycle continues.

Figures 2, 3:
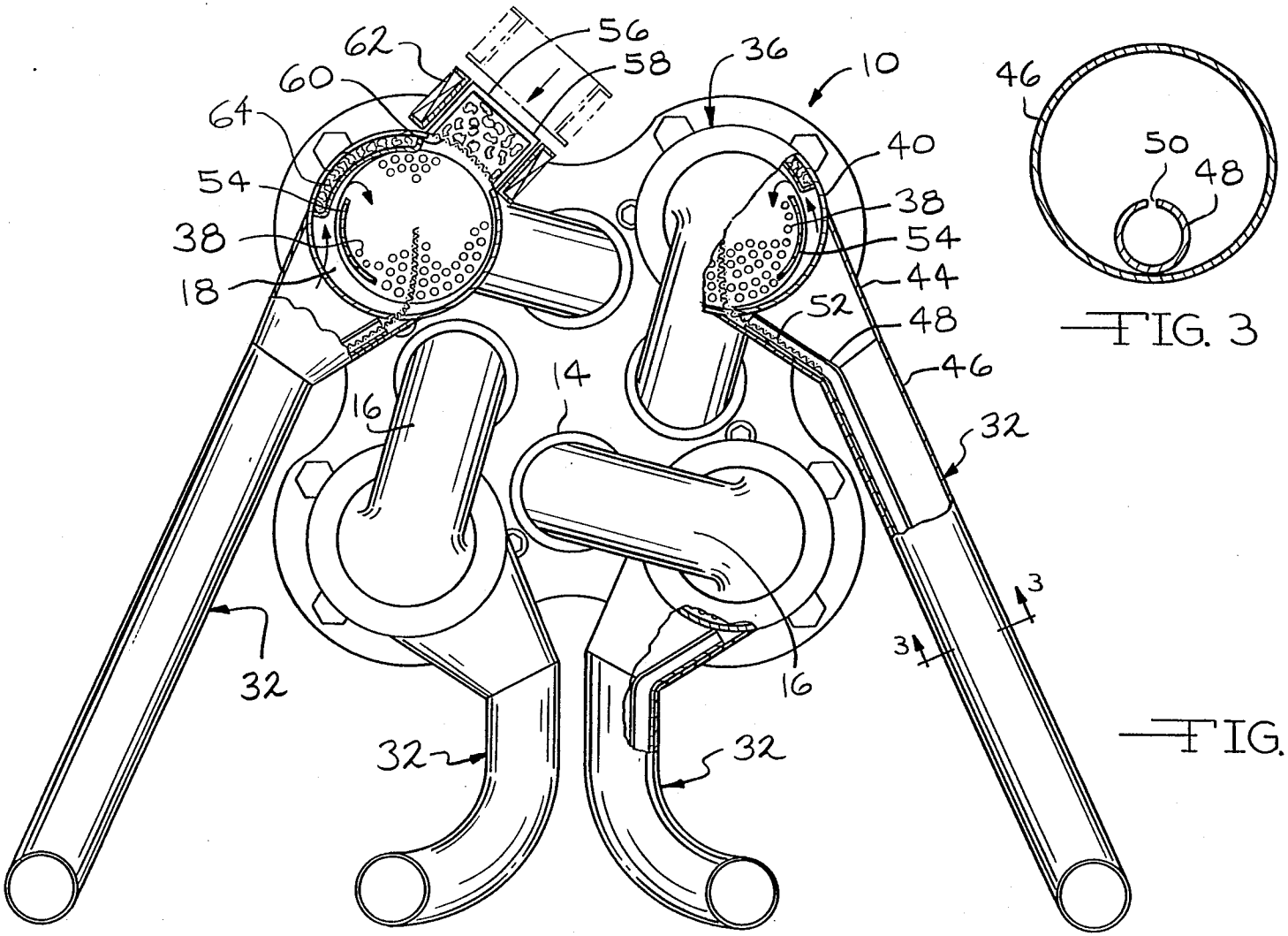
FIG. 2 is a top view of the head assembly of the Stirling engine taken in the direction of arrows 2—2 from FIG. 1.
FIG. 3 is a cross sectional view taken along line 3—3 of FIG. 2.

FIG. 2 shows details of the construction of engine head assembly 36. Heat exchanger 18 acts as the heat pipe condenser and includes a compact internal bundle 38 of relatively small diameter tubes which conduct the working fluid of the Stirling engine and isolate it from the working fluid of the heat pipe. Cylindrical shell 40 surrounds tube bundle 38 and joins with conduit assembly 32. In the region where conduit assembly 32 joins cylindrical shell 40, high velocities of vaporized working fluid are present, particularly at high power settings for engine 10. As mentioned previously, with prior art designs, problems were encountered with liquid heat pipe working fluid becoming entrained within the vapor. In accordance with this invention, several features are provided to minimize the likelihood of such entrainment. Conduit assembly 32 forms a flared shell 44 which provides an increased cross-sectional area as the conduit approaches bundle 38. The increased cross-sectional area as compared with that of the main tube section 46 forming the remainder of conduit assembly 32 causes incoming vaporized working fluid to have a reduced velocity in the area where it contacts bundle 38. Such reductions in velocity have been found to reduce liquid entrainment.

Another counter-measure employed to prevent entrainment is the use of a separate liquid return duct 48 which is disposed within main tube 46 and shell 44, and has a significantly smaller cross-sectional area than main tube 46. Liquid return duct 48 is positioned along the lower-most surface of shell 44 so that liquid collecting in that area by gravity will be guided into duct 48. Liquid return duct 48 features apertures such as a longitudinal slit 50 provided for pressure equalization between the conduits. Each of the four cylinder and column assemblies shown in Figures 1 and 2 includes its own heat pipe conduit assembly 32 constructed as previously described.

Due to the compactness and large surface area presented by tube bundle 38, there is a tendency for liquid heat pipe working fluid to collect within heat exchanger 18 due to capillary action. As a means of reducing this retained liquid volume, surface tension breakers 52 are provided in the form of strips of woven wire mesh which extends from within tube bundle 38 into liquid return conduit 48. Various numbers of surface tension breakers could be used with preferably one for each row of tubes forming bundle 38. Surface tension breaker 52 "wicks" the liquid heat pipe fluid working fluid into liquid return conduit 48 which reduces the volume of liquid retained in that area.

As shown in FIG. 2, baffles 54 are shown which shield a portion of tube bundles 38. Baffles 54 are positioned so that gas traveling through conduit assembly 32 does not directly impact tube bundle 38 but is guided to the upper portion of the tube bundle where it is permitted to flow downwardly through the tube bundle. Condensed heat pipe working fluid is allowed to fall into liquid return duct 48. Baffle 54 tends to maintain the liquid and gas phases of the heat pipe working fluid flowing in the same direction in a continuous circulating manner thus avoiding counterflow conditions which increase the likelihood of entrainment.

Prior to starting Stirling engine 10 for the first time, contaminant gases which invariably collect within the heat pipe system need to be evacuated. Such gases such as hydrogen, oxygen, nitrogen, carbon monoxide and carbon dioxide are present from a number of sources, for example, outgasing of the heat pipe material, and the heat pipe working fluid. The presence of such gasses interferes with proper operation of the heat pipe since they can form a gas "plug" which restricts working fluid flow since the contaminant gases will collect around tube bundle 38 and thus prevent good heat conduction to the Stirling engine cycle. As a means of eliminating or reducing the presence of such contamination gasses, Stirling engine 10 incorporates getter 56 which is affixed to cylindrical shell 40 in a fluid-tight manner. Getter shell 58 forms an internal compartment which is filled with chemical degassers such as calcium and lanthanum. The contents of shell 58 are retained in place by wire mesh 60. A heated collar 62 is provided which surround shell 58 and heats the contents of the getter 56 to a temperature preferably between 600 and 800 degrees C. to enhance its gas absorption characteristics. The phantom line illustration of heated collar 62 in FIG. 2 shows its installation around getter shell 58. Getter 56 is positioned in the upper portion of heat exchanger 18 where contaminant gases tend to collect. The contaminant gases forming in the area of heat exchanger 18 interfere with the transfer of heated working fluid from heat pipe evaporator 26, thus preventing it from being heated directly by the working fluid. By employing the external heat source of collar 62, getter 56 can be used to immediately absorb the contaminant gases, allowing the heat pipe working fluid to reach heat exchanger 18. After initial operation of getter 56 and heated collar 62, the heated collar can be removed from the engine since getter 56 will thereafter be heated sufficiently by the heat pipe working fluid due to the relatively small quantities of contaminant gases which tend to collect after initial startup of the engine 10 and the heat pipe. An additional internal getter 64 is provided directly in the flow path of the vapor such that entrained impurities are forced to flow through the internal getter.

While the above description constitutes the preferred embodiments of the present invention, it will be appreciated that the invention is susceptible to modification, variation and change without departing from the proper scope and fair meaning of the accompanying claims.

What is claimed is:

1. A heat pipe working fluid conduit assembly for transferring vaporized working fluid from a heat pipe evaporator to a heat exchanger of a Stirling engine and for returning liquid working fluid from said heat exchanger to said evaporator comprising:

a conduit communicating with said evaporator and said heat exchanger for transferring said vaporized working fluid, said conduit having a flared shell joining said heat exchanger whereby the cross-sectional area of said conduit increases as said vaporized working fluid approaches said heat exchanger, and a duct disposed inside said conduit extending into said flared shell and having an inlet within said flared shell for receiving said liquid working fluid from said heat exchanger and returning said liquid to said evaporator.

2. A heat pipe working fluid conduit assembly according to claim 1 wherein said duct has an aperture along its length to equalize pressure between said conduit and said duct.

3. A heat pipe working fluid conduit assembly according to claim 2 wherein said aperture is a longitudinal slit.

4. A heat pipe working fluid conduit assembly according to claim 1 further comprising at least one surface tension breaker communicating said heat exchanger with said duct for wicking said liquid working fluid from said heat exchanger to said duct.

5. A heat pipe working fluid conduit assembly according to claim 1 wherein said Stirling engine comprises a plurality of cylinders each having an adjacent column formed by a cooler, regenerator, and said heat exchanger, with a connecting duct communicating said column with said cylinder.

6. A heat pipe working fluid conduit assembly according to claim 1 wherein said heat exchanger comprises a plurality of tubes with said heat pipe working fluid condensing onto the outside said tubes.

7. A heat pipe working fluid conduit assembly according to claim 1 further comprising a baffle partially shielding said heat exchanger for guiding said vaporized working fluid to an upper portion of said heat exchanger whereby said vaporized working fluid is directed to flow downwardly through said heat exchanger and said liquid working fluid condensing within said heat exchanger and falling into said duct.

8. A heat pipe working fluid conduit assembly for transferring vaporized working fluid from a heat pipe evaporator to a heat exchanger of a Stirling engine and for returning liquid working fluid from said heat exchanger to said evaporator, said engine of the type having a plurality of cylinders each having an adjacent cylindrical shell enclosing said heat exchanger, comprising:

a conduit communicating with said evaporator and said heat exchanger for transferring said vaporized working liquid, said conduit having a flared shell joining said heat exchanger cylindrical shell, whereby the cross-sectional area of said conduit increases as said vaporized working fluid approaches said heat exchanger, and a duct disposed inside said conduit for receiving said liquid working fluid from said heat exchanger and returning said liquid to said evaporator, said duct extending into said flared shell and having an inlet disposed in said flared shell and positioned at a lower area of said flared shell for receiving condensed liquid heat pipe working fluid.

9. A heat pipe working fluid conduit assembly according to claim 8 wherein said duct has an aperture along its length to equalize pressure between said conduit and said duct.

10. A heat pipe working fluid conduit assembly according to claim 9 wherein said aperture is a longitudinal slit.

11. A heat pipe working fluid conduit assembly according to claim 8 further comprising at least one surface tension breaker communicating said heat exchanger with said duct inlet for wicking liquid working fluid from said heat exchanger to said duct.

12. A heat pipe working fluid conduit assembly according to claim 8 wherein said heat exchanger comprises a plurality of tubes with said heat pipe working fluid flowing outside said tubes.

13. A heat pipe working fluid conduit assembly according to claim 8 further comprising a baffle partially shielding said heat exchanger for guiding said vaporized working fluid to an upper portion of said heat exchanger whereby said vaporized working fluid is directed to flow downwardly through said heat exchanger and said liquid working fluid condensing within said heat exchanger and falling into said duct.

14. A heat pipe working fluid conduit assembly for transferring vaporized working fluid from a heat pipe evaporator to a heat exchanger of a Stirling engine and for returning liquid working fluid from said heat exchanger to said evaporator comprising:

a conduit communicating with said evaporator and said heat exchanger for transferring said vaporized working fluid, said conduit having a flared shell joining said heat exchanger whereby the cross-sectional area of said conduit increases as said conduit approaches said heat exchanger, and a duct disposed inside said conduit for receiving said liquid working fluid from said heat exchanger and returning said liquid to said evaporator, wherein said duct has an aperture along its length to equalize pressure between said conduit and said duct.

15. A heat pipe working fluid conduit assembly according to claim 14 wherein said aperture is a longitudinal slit.

16. A heat pipe working fluid conduit assembly for transferring vaporized working fluid from a heat pipe evaporator to a heat exchanger of a Stirling engine and for returning liquid working fluid from said heat exchanger to said evaporator comprising:

a conduit communicating with said evaporator and said heat exchanger for transferring said vaporized working fluid, said conduit having a flared shell joining said heat exchanger whereby the cross-sectional area of said conduit increases as said conduit approaches said heat exchanger, a duct disposed inside said conduit for receiving said liquid working fluid from said heat exchanger and returning said liquid to said evaporator, and at least one surface tension breaker communicating said heat exchanger with said duct for wicking said liquid working fluid from said heat exchanger to said duct.

17. A heat pipe working fluid conduit assembly for transferring vaporized working fluid from a heat pipe evaporator to a heat exchanger of a Stirling engine and for returning liquid working fluid from said heat exchanger to said evaporator comprising:

a conduit communicating with said evaporator and said heat exchanger for transferring said vaporized working fluid, said conduit having a flared shell joining said heat exchanger whereby the cross-sectional area of said conduit increases as said conduit approaches said heat exchanger, a duct disposed inside said conduit for receiving said liquid working fluid from said heat exchanger and returning said liquid to said evaporator, and a baffle partially shielding said heat exchanger for guiding said vaporized working fluid to an upper portion of said heat exchanger whereby said vaporized working fluid is directed to flow downwardly through said heat exchanger and said liquid working fluid condensing within said heat exchanger and falling into said duct.

18. A heat pipe working fluid conduit assembly for transferring vaporized working fluid from a heat pipe evaporator to a heat exchanger of a Stirling engine and for returning liquid working fluid from said heat exchanger to said evaporator, said engine of the type having a plurality of cylinders each having an adjacent cylindrical shell enclosing said heat exchanger, comprising:

a conduit communicating with said evaporator and said heat exchanger for transferring said vaporized working liquid, said conduit having a flared shell joining said heat exchanger cylindrical shell, whereby the cross-sectional area of said conduit increases as said conduit approaches said heat exchanger, and a duct disposed inside said conduit for receiving said liquid working fluid from said heat exchanger and returning said liquid to said evaporator, said duct having an inlet disposed in said flared shell and positioned at a lower area of said flared shell for receiving condensed liquid heat pipe working fluid, wherein said duct has an aperture along its length to equalize pressure between said conduit and said duct.

19. A heat pipe working fluid conduit assembly according to claim 18 wherein said aperture is a longitudinal slit.

20. A heat pipe working fluid conduit assembly for transferring vaporized working fluid from a heat pipe evaporator to a heat exchanger of a Stirling engine and for returning liquid working fluid from said heat exchanger to said evaporator, said engine of the type having a plurality of cylinders each having an adjacent cylindrical shell enclosing said heat exchanger, comprising:

a conduit communicating with said evaporator and said heat exchanger for transferring said vaporized working liquid, said conduit having a flared shell joining said heat exchanger cylindrical shell, whereby the cross-sectional area of said conduit increases as said conduit approaches said heat exchanger, a duct disposed inside said conduit for receiving said liquid working fluid from said heat exchanger and returning said liquid to said evaporator, said duct having an inlet disposed in said flared shell and positioned at a lower area of said flared shell for receiving condensed liquid heat pipe working fluid, and at least one surface tension breaker communicating said heat exchanger with said duct inlet for wicking liquid working fluid from said heat exchanger to said duct.

21. A heat pipe working fluid conduit assembly for transferring vaporized working fluid from a heat pipe evaporator to a heat exchanger of a Stirling engine and for returning liquid working fluid from said heat exchanger to said evaporator, said engine of the type having a plurality of cylinders each having an adjacent cylindrical shell enclosing said heat exchanger, comprising:

a conduit communicating with said evaporator and said heat exchanger for transferring said vaporized working liquid, said conduit having a flared shell joining said heat exchanger cylindrical shell, whereby the cross-sectional area of said conduit increases as said conduit approaches said heat exchanger, a duct disposed inside said conduit for receiving said liquid working fluid from said heat exchanger and returning said liquid to said evaporator, said duct having an inlet disposed in said flared shell and positioned at a lower area of said flared shell for receiving condensed liquid heat pipe working fluid, and a baffle partially shielding said heat exchanger for guiding said vaporized working fluid to an upper portion of said heat exchanger whereby said vaporized working fluid is directed to flow downwardly through said heat exchanger and said liquid working fluid condensing within said heat exchanger and falling into said duct.

22. A heat pipe working fluid conduit assembly for transferring vaporized working fluid from a heat pipe evaporator to a heat exchanger of a Stirling engine and for returning liquid working fluid from said heat exchanger to said evaporator comprising:

a shell generally surrounding said heat exchanger, a conduit connected to said shell and cooperating with said shell to cause said vaporized working fluid to flow in a downward direction through said heat exchanger, and a duct disposed in said conduit and having an inlet positioned to receive liquid working fluid flowing downwardly from said heat exchanger, said duct returning said liquid to said evaporator.

* * * * *